US005136968A

United States Patent [19]

Sarada et al.

[11] Patent Number: 5,136,968

[45] Date of Patent: Aug. 11, 1992

[54] SUSTAINED RELEASE INK DISPENSER

[75] Inventors: Thyagaraj Sarada, Norwalk; Judith D. Auslander, Westport; Richard Bernard, Norwalk, all of Conn.

[73] Assignee: Pitney Bowes Inc., Stamford, Conn.

[21] Appl. No.: 459,613

[22] Filed: Jan. 2, 1990

[51] Int. Cl.[5] ..... B05C 1/00; B41K 1/54

[52] U.S. Cl. ..... 118/264; 29/132; 101/333; 101/348; 118/270; 428/321.3; 428/315.5; 428/315.7; 428/909

[58] Field of Search ..... 118/212, 243, 263, 264, 118/270; 101/333, 338, 348, 353, 354, 359, 367; 29/132; 428/321.3, 315.5, 315.7, 909

[56] References Cited

U.S. PATENT DOCUMENTS

| | | | |
|---|---|---|---|
| 3,336,244 | 8/1967 | Rockoff | 101/367 |
| 3,491,685 | 1/1970 | Tramposch | 101/350 |
| 3,812,782 | 5/1974 | Funahashi | 101/367 |
| 3,851,619 | 12/1974 | Cofield, Jr. et al. | 118/264 |
| 3,971,315 | 7/1976 | Hansen | 101/367 |
| 4,246,842 | 1/1981 | Williams et al. | 101/348 |
| 5,049,432 | 9/1991 | Ooms et al. | 101/333 X |

*Primary Examiner*—Michael G. Wityshyn

*Attorney, Agent, or Firm*—Peter Vrahotes; Melvin J. Scolnick

[57] ABSTRACT

An ink dispensing device is disclosed wherein the ink releasing member comprises two layers that serve different purposes. The layer which contacts a printing font is made of a porous material that has an open pore size of less than 30 microns and a porosity of 40% to 85%. The second layer is adjacent to the contact layer and is made from an elastic foam with larger pore size, in the range of 80 microns to 1000 microns and a porosity of greater than 70%. The second layer is impregnated with ink and acts as a reservoir for the first layer, the latter serving as a metering member.

19 Claims, 6 Drawing Sheets

SUSTAINED RELEASE INK DISPENSER

BACKGROUND OF THE INVENTION

There are many instances in which it is desirous to have a sustained rate of release of a fluid such as ink, moistening fluids, adhesives and the like over an extended period and a large number of cycles. Examples of materials where such sustained rates of release are desirable include ink pads and ink rollers in inking systems. Examples of the use of ink pads are pads that are applied to print elements in order to transfer ink therefrom onto sheets made of paper, plastic, film and the like. Ink pads are used in devices such as postage meters whereby a postage indicia can be printed upon an envelope by contacting an ink laden pad with a print element having dies made of a metal, alloy, rubber, photopolymer, and the like and impacting the latter upon an envelope. Another form of an ink releasing mechanism is a roller. Examples where ink rollers are used are in labellers for price marking and postage meters. The ink roller serves as a source of ink for the labeller and postage meter, and the ink is transferred by appropriate mechanisms to a ticket, tag or label in the case of labellers and to a print element in the case of a postage meter as discussed previously.

Having a uniform, constant rate of release of ink has been a goal in the production of such devices for a long time. Obviously, the ideal situation is where the first ink impression and the last ink impression are of the same ink density. Clearly, this is an unlikely achievement in depleting devices. Nevertheless, it would be advantageous having the first and last inking impressions as close to one another as possible in terms of ink density. Ink density is clearly related to the amount of ink transferred. The amount of ink transferred is related to the rate of release from the roller or the pad. More specifically, this rate should be close to a constant or the change in the rate should be small. Further, because of a predetermined constant bulk volume dictated by the printing mechanism, prior ink rollers and pads provided a limited number of print cycles with a pay off of 15–25% of the total volume of ink impregnated in the foam.

Inks that are ideal for sustained release should have all the active ingredients (solvents, toners, dyes, etc.) moving as a homogenous phase. Currently, a constraint in ink making is the matter of toxicity since consideration must be given towards environmental factors. This is also true of inks that are used with dispensing pads and rollers. In the past, many inks have been used, as for example with rubber stamps, that have been found to have undesirably high toxic levels, but presently, wide spread efforts are underway to produce inks with solvents that are low in toxicity. For some applications the ink should also be non-volatile, and have low vapor pressure. In addition, the inks should also be non-destructive to the pads, rollers, print elements and other materials with which they come in contact.

There are certain inks that have coloring materials such as dyes and toners that are visually detectable and others with both coloring materials and fluorescent materials as well. In such systems, both the coloring materials and fluorescent materials should be dispensed slowly by the inking mechanism and at the same rate over a long term. An example of where inking and fluorescent materials are used in an inking pad or roller is the postage meter. A postage meter either will have an inking roller as is common in a drum-type postage meter and flat bed meters, or it can have a pad in a flat bed type postage meter.

A factor that works against sustained rates of release are the mechanisms in which they are used. In postage meters using rollers, for example, the mechanism involves constant engagement of the roller with the print element and such engagements cause non-uniform stress field across the rollers. The stress field applied on a roller is non-uniform and time dependent due to the foam/ink intrinsic properties. This stress is also dependent on the viscoelastic properties of the polymer, porosity and pore size of the foam and the amount of the ink available. As the ink depletes and the polymer is mechanically deformed simultaneously, the rate of ink release decreases.

SUMMARY OF THE INVENTION

The ink dispensing devices of the instant invention are made of multiple components selected on the basis of their chemical affinity for the ink. Fluid release, and mechanical properties such as transport and transfer are controlled by the chemical affinity. It has been found that a combination of an ink storage layer and an ink metering layer made of distinct materials has resulted in pads and rollers that have solved the problems enumerated previously in a surprisingly effective manner and has resulted in sustained ink release over an extended period. Of course, what is meant by sustained ink release is a relatively uniform rate of dispensing ink by the inking mechanism over a given period. In the case of rollers, the internal layer, or core, and in the case of pads, the inner layer, acts as an ink reservoir while the outside layer, meters the ink in a uniform manner so that there is a relatively constant release of ink over a long period and a large number of cycles. The internal core can be an elastic foam with large pore size, in the range of 80μ to 1000μ, porosity of greater than 70% and impregnated or plasticized with ink. The outer or metering layer is a porous sleeve with smaller pores, less than 30μ open pore size and a lower porosity, 40% to 85%. The rollers of the instant invention also provide a much higher number of print cycles, 15,000 cycles vs. 4,000 cycles for the same bulk dimensions with superior print quality.

DETAILED DESCRIPTION OF THE PREFERRED EMBODIMENTS

There are certain inking mechanisms wherein ink is held by a first member and is dispensed gradually by contact with a second member such as a print element or printhead. This is in contrast to other types of inking mechanism wherein a sump of ink is available, and ink is dispensed as needed to a pad or roller. In the former type of device, one of the problems has been to have the ink stored in the initial member released gradually so that inking impressions can be relatively uniform throughout the life of such inking mechanism. The solution to this problem in accordance with the instant invention involves the use of composites selected on the basis of their permeability, transfer, transport and mechanical properties.

Figure 1:
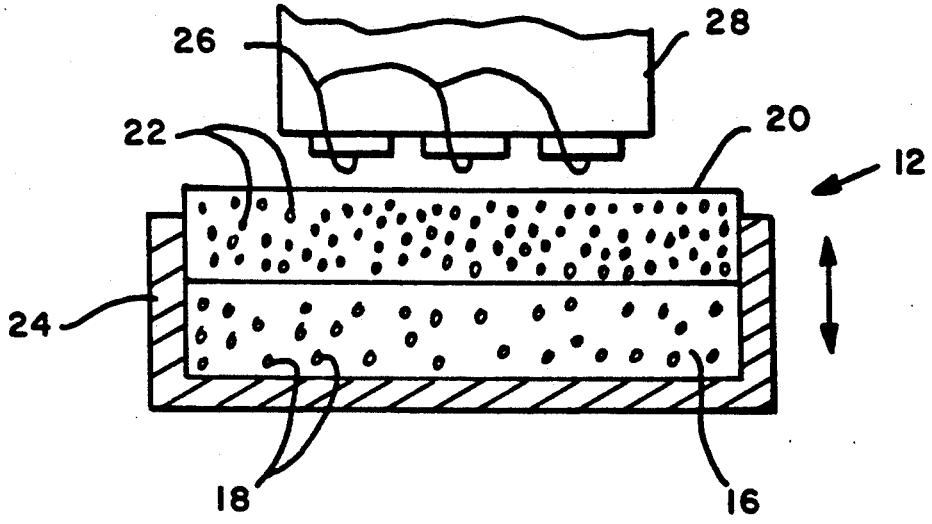
FIG. 1 is a cross sectional view of an ink pad made in accordance with the instant invention.
Figure 2:
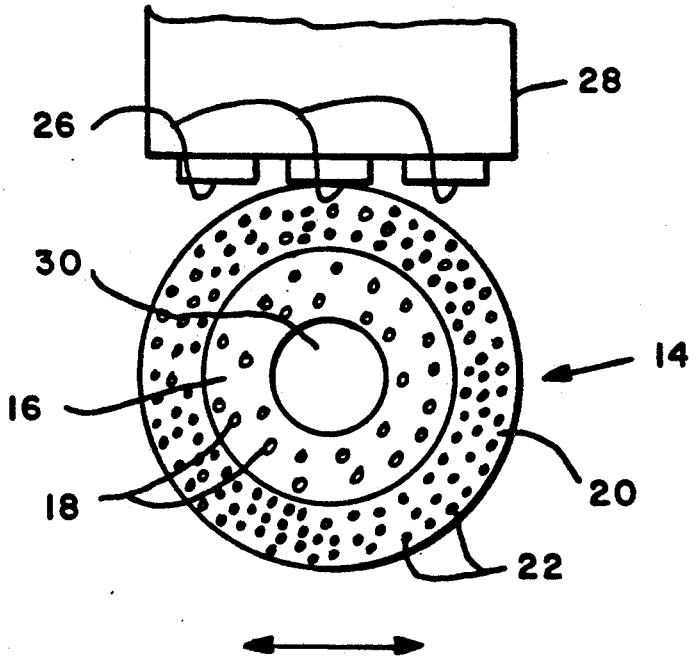
FIG. 2 is a cross sectional view of an ink roller made in accordance with the instant invention.

With reference to FIG. 1, wherein a pad 12 is shown, and FIG. 2, wherein a roller is shown, a first, or inner member 16 of the mechanism is made of an elastic foam with large interconnected pores 18 (open cell foams), the pore size being in the range of 80μ to 1000μ and a porosity greater than 70%. This inner layer 16 will act as a reservoir for ink with which it is to be impregnated. A second layer 20 is made of chemically inert material and serves as a metering layer which has small pores 22, less than 30μ.

With specific reference to FIG. 1, the first and second layers 16,20 are received within a frame 24 that is secured to a driving mechanism (not shown) for reciprocal movement, as indicated by the arrow, whereby the outer layer 20 can be brought into contact with the fonts 26 of a print head 28 and disengaged therefrom. The print head 28, would then be engaged by a sheet for printing thereon in any convenient manner. With reference to FIG. 2, the invention is illustrated as incorporated in a roller 14. A rotatable shaft 30 supports a foam material composite having an inner layer 16 having larger pores 18, again, in the range of 80μ to 1000μ, and a porosity greater than 50% and an outer layer 20 having smaller pores 22 of a size less than 30μ. The roller 14 is moved reciprocally, as inducted by the arrow, by a mechanism (not shown) so as to be contactingly driven across the fonts 26 of a printing element 28. As the roller 14 contacts the fonts 26, it dispenses ink thereon that can later be applied to a sheet. The ratio of the thickness of the first layer 16 to the thickness of the second layer 20 should be in the range of 4:1 to 10:1.

The ink release from conventional monolith pads and rollers can be described by the following equation:

$$MC = Mo \exp(-kc)$$

where

Mo equals initial weight of inked foam member
Mc = weight at cycle c
k = release rate constant
c = cycle number With the instant composite inking members, the rate of release is approximated by the following formula:

$$Mc = Mo - kc$$

where

Mo = weight at cycle c
Mo = initial weight of inked foam member
k = release rate constant It will be noted that with this equation there is no exponential factor and therefore no concentration dependence.

Major factors which have been found that diminish the uniform release of ink and limits the ink pay off are as follows:

1. Closed cells in the foam that have no interconnection.
2. Improper pore characteristics such as distribution and diameter.
3. Weak pumping action through capillary pressure.
4. Deformation of elastomer. (Decrease in resilience of foam due to viscollastic material properties and viscous force of inks).
5. Clogging of pores through time.
6. Absorption of liquid ink into the polymer of the foam resulting in an inability to dispense ink, i.e. lack of fluid release.

With regard to the first layer 16, i.e. the member with large pores that serves as an ink reservoir, certain materials were found preferable. This first layer should be made of a foam of high chemical compatibility or affinity for the type of inks that are used, such as polyvinyl alcohol acetalized with formaldehyde (PVAF) with a porosity, or percentage void volume, greater than 70%. By chemical affinity is meant the two materials, i.e. foam and ink, have similar functional groups or polarity expressed, for example, in solubility parameters. The solubility parameters to be used for the solvents and resins should be greater than (9.2 cal/cm $^3$) with moderate or strong hydrogen bonding as defined by the Hildebrand equation. The degree of acetalization should be approximately 60% to 70% which is hereby defined as low acetalization. Foam made of PVAF has been found to be the most preferred because of its high mechanical strength at low densities, good recovery from compression when inked, and its ability to incorporate a large volume of ink. Other foams that can be used are polyurethane ester with different degrees of cross linking, and polystyrene/acrylate and melamine/formaldehyde. Some of the foams were plasticized by solvents with high hydrogen bonding capacity such as glycols especially polyethylene glycols, and polypropylene glycols and alcohols. The plasticization as defined in this specification is a partial plasticization as opposed to permanent plasticization and is achieved in the case of PVAF and other similar foams by heating the foam with the inks therein between 70° C. and 100° C. for 10 minutes to one hour. Foams such as polyurethane have a high affinity for hydrogen bonding solvents such as glycols and glycol ethers and are plasticized readily by impregnations at room temperatures. In a roller where the core has been plasticized the core 16 will swell inside the sleeve 20 to form a mechanical bond there between. The sleeve 20 will not become plasticized since it is inert and will retain its original dimension and thus compress the core. The plasticized foam becomes highly elastic with high fluid flow capacity and absorption capacity for hydrophilic inks without losing their mechanical strength. Sometimes, permanently plasticized foams have been used as rollers to keep them soft and flexible but not for the purpose of enhancing transfer properties.

The second layer 20 meters the ink released from the first layer 16 and is made of a chemically resistant foam. Its function is to preserve the original dimensions of the roller 14 after the release of ink. This layer 20 should have a smooth firm surface with tight pores, less than 30μ. Examples of foams that can be used as a second layer 20 are sintered polyethylene with porosity between 40% and 85% and pore sizes between 7μ and 30μ, as for example nitrile rubber, polypropylene, polyolefin, PVAF with high acetalization of approximately 80% to 86%, which is hereby defined as high acetalization, and polyethylene vinylacetate.

The release rate of the ink from the first layer 16 will follow the cycle of the inking mechanism motion, and the pressure of engagement of the roller 14 or pad 16 with a print element in accordance with a modified Poiseuille law, $$Q = \frac{W\Delta P r^2}{8\delta\eta}$$

where

Q = rate of flow
P = pressure differential
$\delta$ = layer thickness
$\eta$ = viscosity
w = porosity and
r = effective pore radius The replenishment of the ink for the first layer 16 will be governed by its capillary force, and the Fickian diffusion through the polymer to the outer layer 20.

With a top layer 20 having smaller pore sizes, there will be higher capillary pressure and the ink will be pumped more readily from the reservoir layer which has weaker capillarity as expressed by the Laplace equation:

$$Pc = \frac{2\gamma_l \cos\theta}{r}$$

Where

Pc = capillary pressure
$\gamma_l$ = Surface tension of the liquid
r = Average pore radius
$\theta$ = Contact angle of fluid The diffusion coefficient will be significantly higher for the plasticized foams. Also, the partition coefficient of the ink in the PVAF foams is high due to the high hydrophilicity and affinity. The amount of ink supplied to the metering layer is controlled by both mechanical and chemical properties of the roller. The axial flow which results from the compression of the printing element is controlled by the properties of the foam, such as elastic recovery and high permeability. The axial flow of the ink, which is time dependent is controlled by the transport properties of the polymer ink system, such as diffusion and partitioning.

The inks used for such a system must have certain properties. The properties are as follows:

1. Homogenous phase for continuous flow without blocking the pores.
2. A single rate of flow for all active ingredients of the ink.
3. Hydrogen bonding types of solvents with chemical affinity for the above mentioned foams for plasticization of foams as required Examples of such solvents are glycols, glycol ethers, glycol esthers such as polyethylene glycols, alcohol esters and alcohol esthers.
4. Suitable viscosity so that the supply of ink and the release of ink match the pore characteristics closely. The viscosity range should be 600–2,000 cps at ambient for the above system.
5. The surface tension of the ink should match the initial surface energy of the polymer for optimum contact angle so that proper wetting and flow are achieved. Surfactants such as Igepal CO-210, CO-530 and C0-620 which are long chain aliphatic hydrocarbon chains-phenoxy (polyethyleneoxy) ethanol available from GAF Corp , can be used as wetting agents. Other non-ionic surfactants can also be incorporated in the ink.

EXAMPLE I

Figure 3:
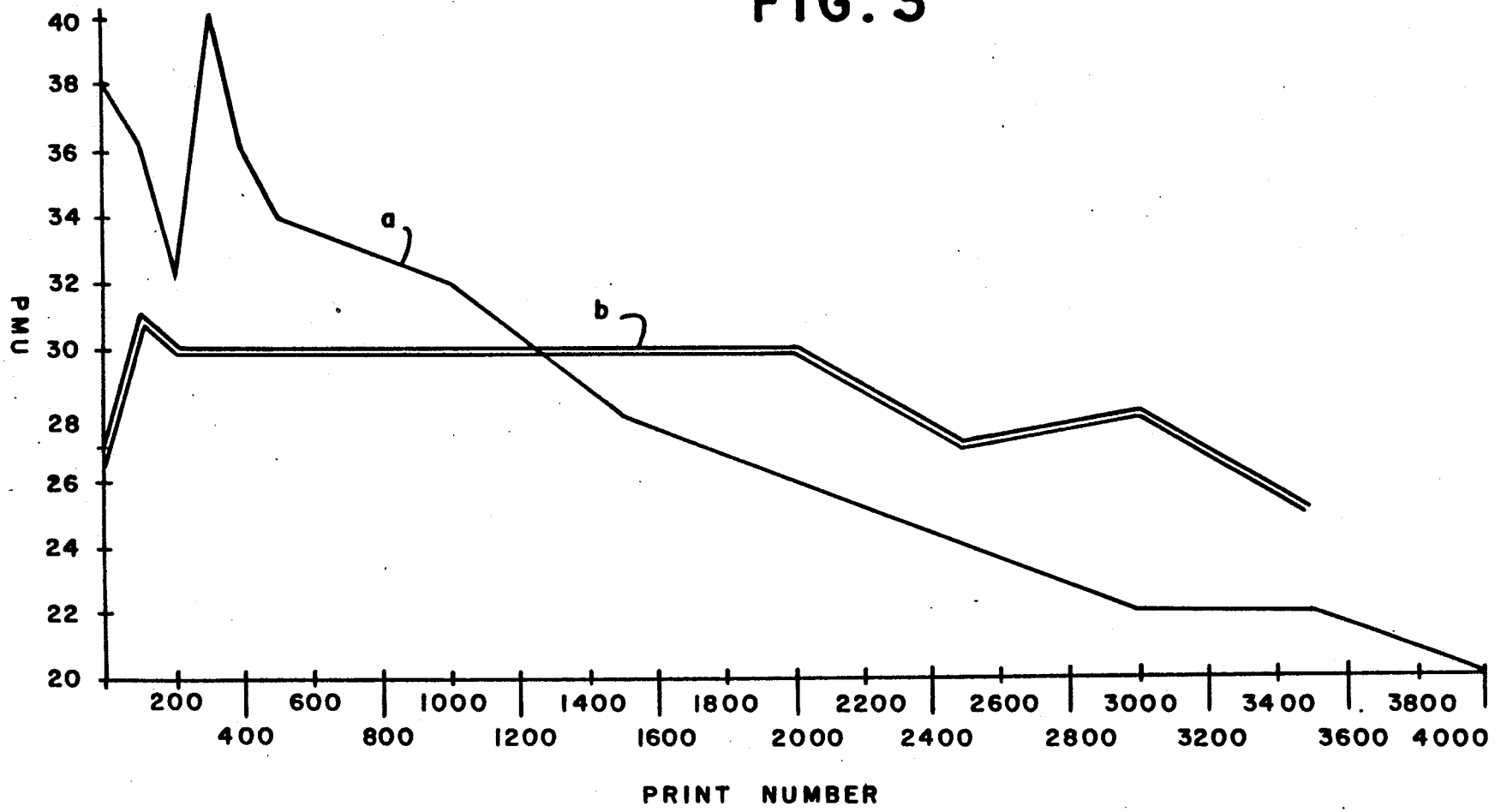
FIGS. 3 through 7 show graphs comparing the performance of prior art rollers against rollers made in accordance with the instant invention.

Referring now to FIG. 3, a graph is shown of a comparison between a prior art monolith roller and a composite roller having a pair of layers made in accordance with the instant invention. The results shown in the graph are a measure of the rate of ink release as indicated by fluorescent intensity measurement read as phosphor meter units (PMU) vs. number of print cycles at 20 prints/min. The roller size was 5.74"(14.6 cm) long with a radius of 0.44"(1.23 cm) including the shaft 28. The monolith roller of prior materials was of Microfoam #60C9G urethane available from Monarch Marking Systems of Dayton, Oh. Plot "a" shows the rate of ink release of the prior art material. The ink used in this Example contained mainly 38% concentration of fluorescent pigment, 39% solvent of triethylene glycol, 10% surfactant nonyl phenoxy (polytethyleneoxy) ethanol, and 10% surfactant oleyl alcohol ethoxylate and 0.5% coloring dye. As is seen, the rate of ink release is relatively high during the initial four hundred prints and then begins to fall off quickly. Results using composite material of different dimensions are indicated by plot "b". The roller of plot "b" had a core of PVAF with a porosity of 90%, 130μ pore size and a thickness of 90 mils. and a sleeve of polyethylene with a porosity of 41.9%, a nominal pore size of 30μ and a thickness of 50 mils. As can be seen, the rate of ink release for plot "b" was constant over approximately two thousand print cycles and then began to fall. Even after thirty five hundred cycles, the rate of ink release for the composite roller was substantially higher than the prior monolith roller.

EXAMPLE II

Figure 4:
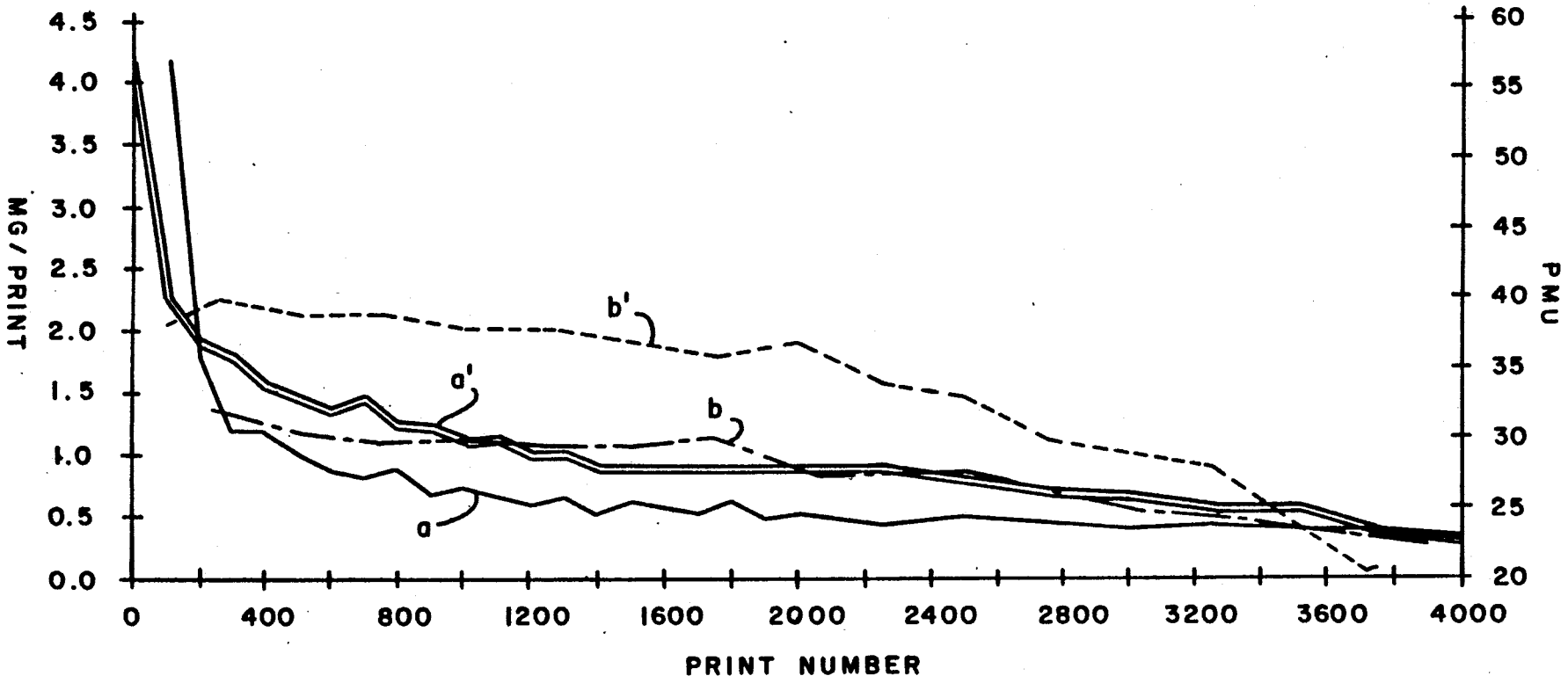

The results of a second comparison under the same conditions as in Example I is shown in FIG. 4 where once more the curves a and a' indicate results achieved with a prior art monolith roller, again a roller made from urethane foam identified as Microfoam #60C9G urethane high porosity foam, and b and b' represent a composite roller made in accordance with the instant invention. As is seen, at the outset the prior art roller released ink at a much higher rate initially, but at a slower rate after a few hundred cycles. The composite roller, whose performance is indicated by plot b, had a relatively uniform rate of ink release although not as uniform as shown in Example I. The composite roller had a core of PVAF with a porosity of 90% and a pore size of 700μ nominal and a sleeve of polyethylene with a porosity of 58.2% and pore size of 12μnominal.

The graph in FIG. 4 is somewhat different from that shown in FIG. 3 in that the ordinate on the left indicates the quantity of ink released upon each contact with a print head and the ordinate on the right is given in phosphorus meter units as explained in relation to FIG. 3. The value of plots a and b' can be obtained by reading the left side ordinate in milligrams per print and plots a' and b' can be interpreted by the right hand ordinate for phosphor meter units (PMU). The amount of ink deposited with the prior art monolith roller, as indicated at a, was large initially and then became relatively uniform after approximately four hundred cycles, although at a lower level. With regard to the detection of fluorescence through the phosphor meter reading, as indicated by curved a' once more one can see a great decrease after approximately four hundred cycles and then after this a rather uniform release is obtained. The release rate is at a lower level than the roller of the invention. With the roller of the instant invention, which as made with a core of PVAF and a sleeve of polyethylene, the amount of ink deposited was rather uniform as is shown in curve b. The fluorescence intensity, as given by curve b', fell off drastically at the end of the print cycle, around 3200 prints. Nevertheless, using the roller of the instant invention yielded a more uniform release of ink and a more uniform fluorescent signal.

EXAMPLE III

Figure 5:
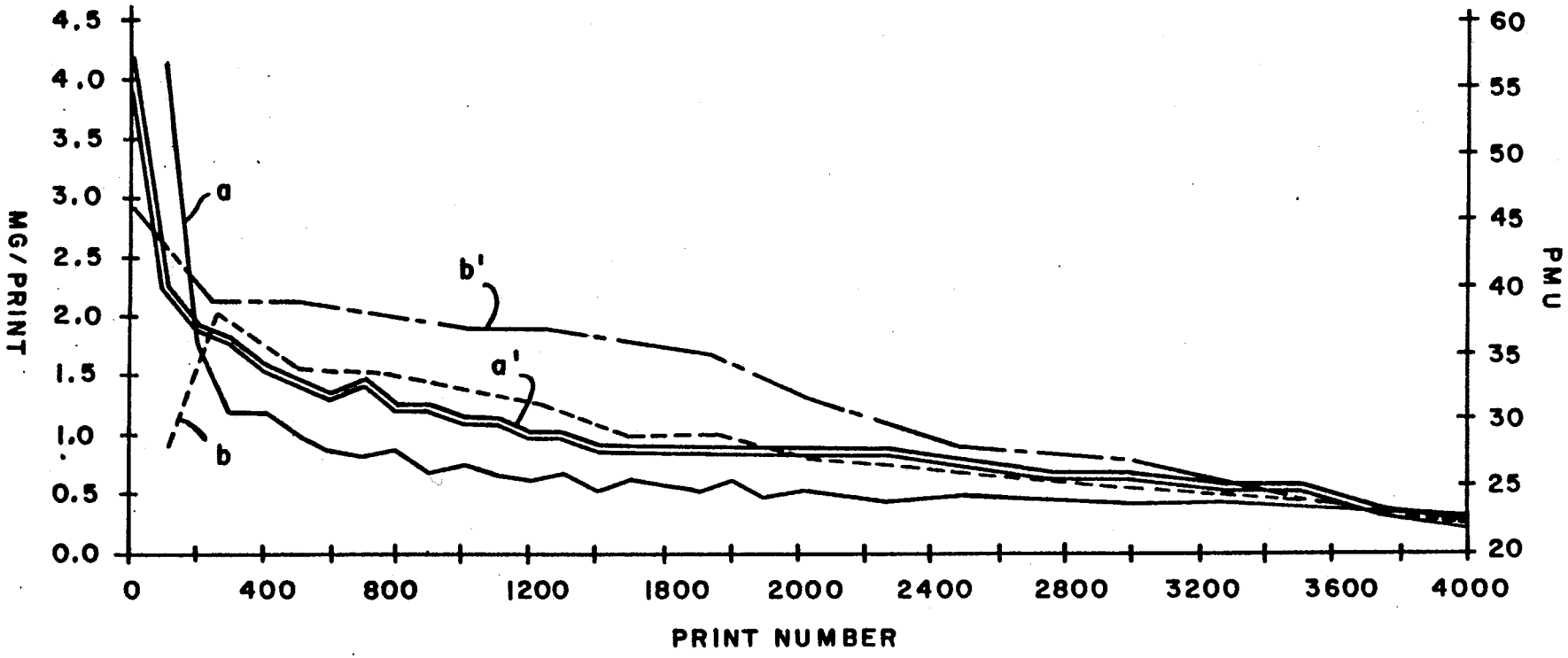

With reference to FIG. 5, an example is given with an inventive roller as used in Example II but with a different pore size. The same urethane monolith roller as used in FIG. 4, or Example 2, was used for comparison. The inventive roller used a PVAF core with a porosity of 92%, 130μ nominal pore size and a thickness of 25 mils with a polyethylene sleeve, the results being indicated by curves a and a' for the standard material at the invention shown in curves b and b'. The results basically duplicate those achieved as given in Example II in that the amount of ink dispensed by the standard material initially was quite high for the first four hundred or so cycles and thereafter dispensed ink at a fairly uniform rate and gave a lower a pore size of 130μ and a polyethylene sleeve with a pore size of 12μ dispensed ink at a relatively uniform rate as is shown in curve b and the fluorescent reading was also uniform except at the end of the cycle as indicated by curve b'. Both the amount of ink dispensed and the fluorescent reading were substantially higher than obtained with the standard monolith roller.

EXAMPLE IV

Figure 6:
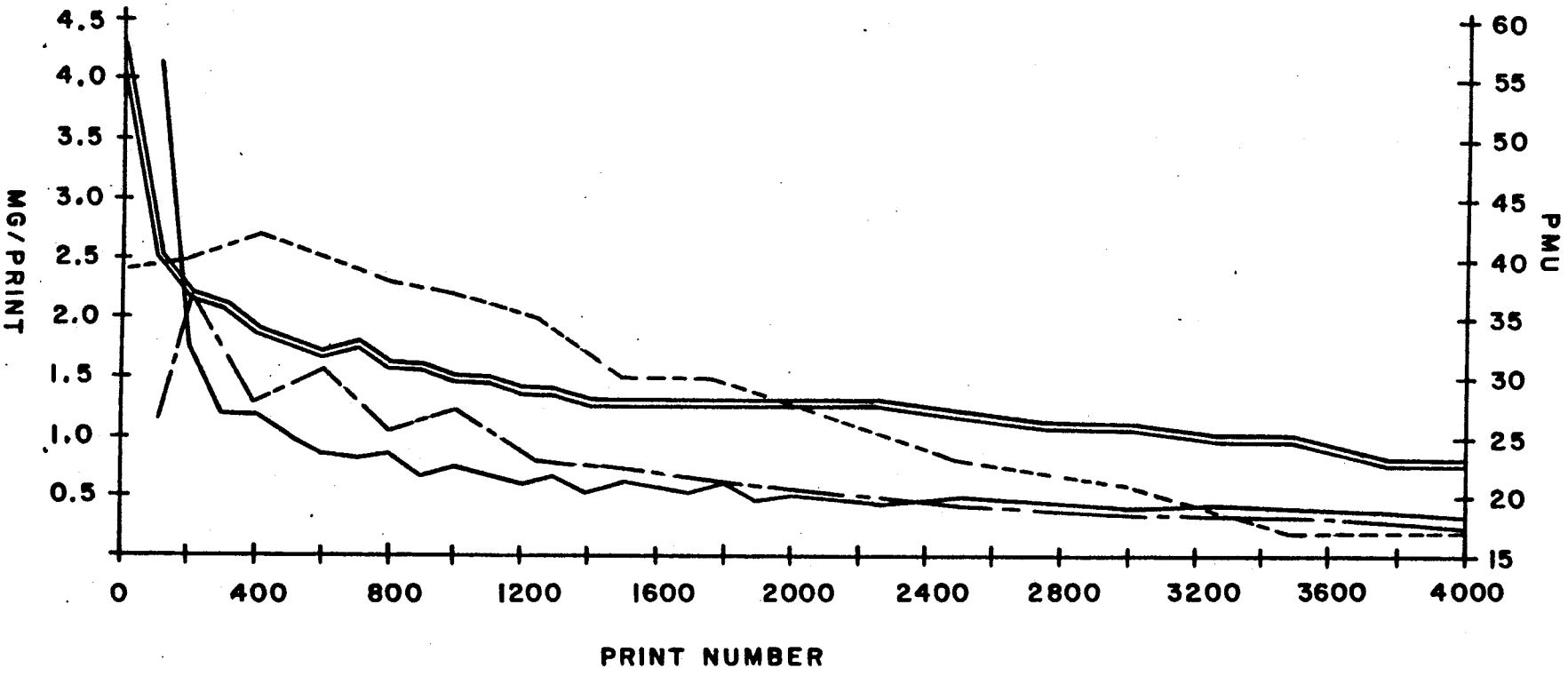

With reference to FIG. 6, an example is given with a composite roller of different materials. The same urethane monolith roller as used in FIG. 4, or Example 2, was used to compare against a roller having a cross linked polyurethane core with a nominal pore size of 100μ and a porosity of 73.2% and a polethylene sleeve with a nominal pore size of 12μ. The results of the roller test are indicated by curves b and b'. With regard to the standard material, the results basically duplicate the results achieved in Examples II and III in that the amount of ink dispensed initially was quite high for the first four hundred or so cycles and thereafter ink was dispensed at a more uniform rate and a lower fluorescent reading was obtained. The combination of the polyurethane core and a polyethylene sleeve dispensed ink at a relatively uniform rate as is shown in cure b and the fluorescent reading was also uniform except at the end of the cycle as shown by curve b'. Both the amount of ink dispensed and the fluorescent readings were higher than obtained with the standard monolith roller.

EXAMPLE V

Figure 7:
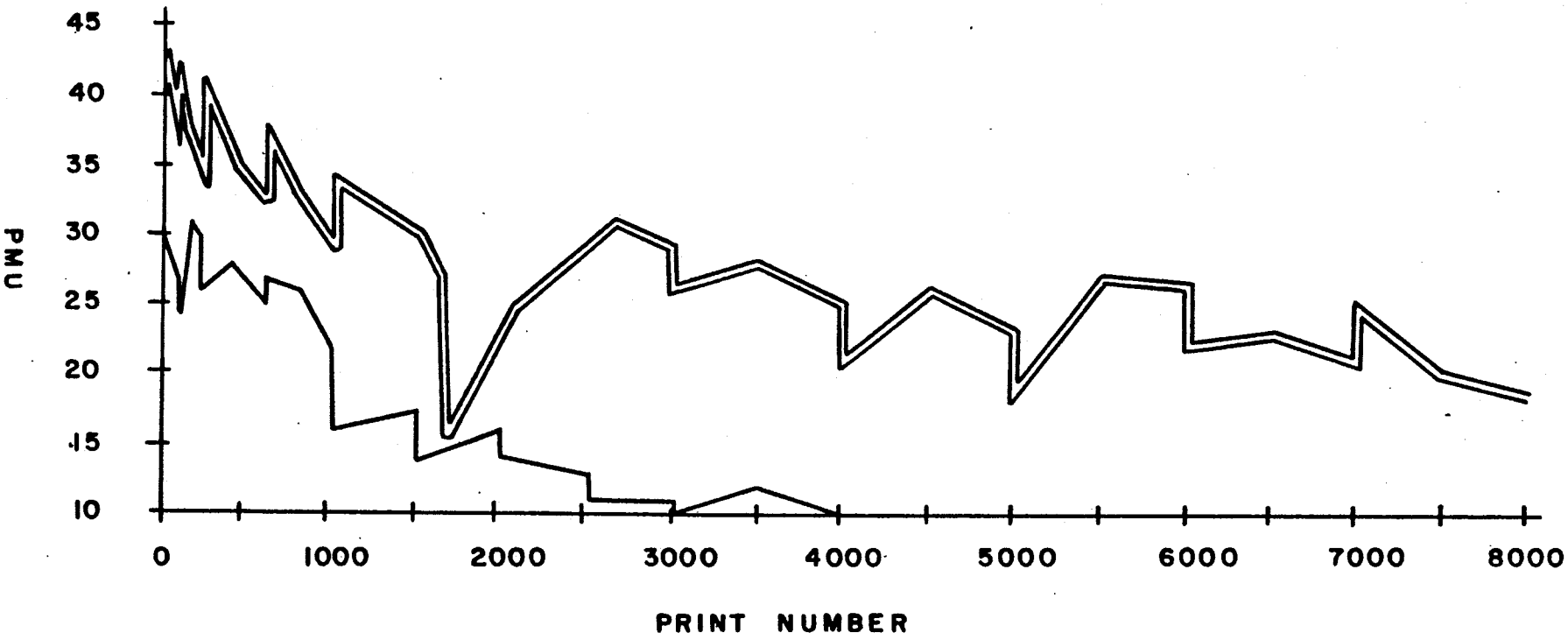

With reference to FIG. 7 an example of a two layered pad with a uniform release of ink is given to exemplify the instant invention. The reservoir, or bottom, layer is made of melamine formaldehyde with a density of 0.7lbs/ft$^3$, a nominal pore size of 140–145 microns and a porosity of 97.2% after being densified at a ratio of 3.5 to 1. The thickness of the reservoir layer was 0.165". The top, or metering, layer was made of polyurethane porous foam with a thickness of 0.020". The PMU was tested in a printing fixture at a speed of 4 prints per second and an engagement (deflection) of 0.03". The results were compared with an inker pad made of a reservoir layer made of neoprene with a density of 12 lbs/ft$^3$, pore size of 100μ nominal diversified at a ratio of 2 to 1. This was bonded to the same top layer as the inventive pad, i.e. polyurethane. As can be seen, the results with the reservoir layer made of melamine formaldehyde was substantially higher than the results with the known material. The intensity obtained from the measurement of the printings was substantially higher and the useful life of the pad was greater.

Thus, what has been shown and described is a combination of foams that can provide sustained ink release over a large number of print cycles. Additionally, it has been found the rollers and pads of the instant inventors result in superior print quality because of the controlled release and improved transfer properties.

What is claimed is:

1. An ink releasing device for the uniform release of ink over a large number of contacts with a printhead, comprising:

a first layer of foam material having chemical affinity for ink received therein and an open pore size in the range of 80μ to 1000μ, nominal, and a second layer of porous material adjacent to and confluent with said first layer of foam material, said first layer being plasticized with ink, and said second layer having an open pore size less than 30μ nominal.

2. The ink releasing device of claim 1 including a frame, said first and second layers being received within said frame with a portion of said second layer being exposed.

3. The ink releasing device of claim 1 wherein said first layer of foam material is selected from the group consisting of polyvinyl alcohol acetalized with formaldehyde, polyurethane and ester, polyurethane ether, polystyrene/acrylate and melamine/formaldehyde.

4. The ink releasing device of claim 3 wherein said second layer is made of a porous material selected from the group consisting of polyolefin, polyethylene vinylacetate, polyvinyl alcohol highly acetalized with formaldehyde, and sintered polyethylene.

5. The ink releasing device of claim 1 wherein said first and second layers form a roller.

6. The ink releasing device of claim 5 wherein at least one of said layers is made of polyvinyl alcohol acetalized with formaldehyde.

7. The ink releasing device of claim 1 wherein said first layer has a porosity greater than 70% and said second layer has a porosity of 40% to 85%.

8. The device of claim 7 wherein the ratio of the thickness of the first layer to the thickness of the second layer is 4:1 to 10:1.

9. The ink releasing device of claim 1 wherein said first and second layers from a pad.

10. An ink releasing device capable of a uniform rate of ink release over time upon contact with a printhead, comprising:

a first layer of foam material having a porosity of 85% to 98%, and a second layer of porous material adjacent to and confluent with said first layer of foam material, said first layer being plasticized with ink, and said second layer of porous material having a pore size of less than 30μ nominal.

11. The ink releasing device of claim 10 wherein said first layer of foam material is selected from the group consisting of polyvinyl alcohol with a low degree of acetalization with formaldehyde, polyurethane ester, polyurethane ether, polystyrene/acrylate, and melamine/formaldehye.

12. The ink releasing device of claim 10 wherein said second layer has a porosity between 40% and 85%.

13. The ink releasing device of claim 10 wherein said second layer is made of a foam material selected from the group consisting of polyethylene, nitrile rubber, and polyvinyl alcohol with a high degree of acetalization with formaldehyde.

14. The ink releasing device of claim 10 wherein said first and second layers form a roller.

15. The ink releasing device of claim 14 wherein said first layer is partially plasticized.

16. The device of claim 15 wherein the ratio of the thickness of said first layer to the thickness of the second layer is 4:1 to 10:1.

17. The ink releasing device of claim 10 wherein said first and second layers form a pad.

18. The ink releasing device of claim 10 wherein at least one of said layers is made of polyvinyl alcohol acetalized with formalehyde.

19. The ink releasing device of claim 10 wherein said first layer has a porosity of 85% to 95% and said second layer is disposed about said first layer and has a porosity of 40% to 85%.

* * * * *